US011490485B2

(12) United States Patent
Fischer

(10) Patent No.: US 11,490,485 B2
(45) Date of Patent: Nov. 1, 2022

(54) MODULE AND CIRCUIT ARRANGEMENT FOR A LIGHT SOURCE

(71) Applicant: OSRAM GmbH, Munich (DE)

(72) Inventor: Klaus Fischer, Friedberg (DE)

(73) Assignee: OSRAM GmbH, Munich (DE)

( * ) Notice: Subject to any disclaimer, the term of this patent is extended or adjusted under 35 U.S.C. 154(b) by 4 days.

(21) Appl. No.: 17/156,660

(22) Filed: Jan. 25, 2021

(65) Prior Publication Data

US 2021/0235561 A1 Jul. 29, 2021

(30) Foreign Application Priority Data

Jan. 27, 2020 (DE) ..... 10 2020 200 929.5
May 25, 2020 (DE) ..... 10 2020 206 439.3

(51) Int. Cl.

| | |
|---|---|
| ***H05B 45/345*** | (2020.01) |
| ***F21V 23/00*** | (2015.01) |
| ***H05B 45/46*** | (2020.01) |
| *F21Y 115/10* | (2016.01) |
| *F21V 23/06* | (2006.01) |

(52) U.S. Cl.

CPC ..... *H05B 45/46* (2020.01); *H05B 45/345* (2020.01); *F21V 23/003* (2013.01); *F21V 23/06* (2013.01); *F21Y 2115/10* (2016.08)

(58) Field of Classification Search

CPC ..... H05B 45/00; H05B 45/40; H05B 45/46; H05B 45/345; F21V 23/00; F21V 23/003; F21V 23/06; F21S 4/00; F21Y 2115/10

See application file for complete search history.

(56) References Cited

U.S. PATENT DOCUMENTS

| | | | | |
|---|---|---|---|---|
| 10,834,792 | B2 * | 11/2020 | Telefus | H05B 45/305 |
| 2012/0212143 | A1 * | 8/2012 | Esaki | H05B 45/52 315/192 |
| 2012/0320595 | A1 | 12/2012 | Enke | |
| 2014/0334156 | A1 | 11/2014 | Lorenz et al. | |

FOREIGN PATENT DOCUMENTS

| | | | |
|---|---|---|---|
| DE | 102010008876 | A1 | 8/2011 |
| DE | 102013208392 | A1 | 11/2014 |

OTHER PUBLICATIONS

German Search Report issued for the corresponding German patent application No. 10 2020 206 439.3, dated Aug. 11, 2021, 7 pages (for informational purposes only).

* cited by examiner

*Primary Examiner* — Jimmy T Vu
(74) *Attorney, Agent, or Firm* — Viering, Jentschura & Partner MBB

(57) ABSTRACT

A circuit arrangement for connecting a plurality of LED modules in parallel comprises a positive pole terminal and a negative pole terminal for connecting a driver, a positive pole terminal line for electrically connecting the positive pole terminal to the modules, a negative pole terminal line for electrically connecting the negative pole terminal to the modules, a plurality of positive pole terminal contacts for electrically connecting the positive pole terminal line to anode terminal contacts of the modules, and a plurality of negative pole terminal contacts for electrically connecting the negative pole terminal line to cathode terminal contacts of the modules.

14 Claims, 4 Drawing Sheets

MODULE AND CIRCUIT ARRANGEMENT FOR A LIGHT SOURCE

CROSS-REFERENCE TO RELATED APPLICATIONS

This application claims priority to German Application 10 2020 200 929.5, filed on Jan. 27, 2020, and German Application 20 2020 206 439.3, filed on May 25, 2020, the contact of each of which are incorporated herein by reference in their entirety.

TECHNICAL FIELD

The present disclosure relates to a module and a circuit arrangement for a light source including a plurality of light emitting diodes (LEDs).

BACKGROUND

In general, one or more LED modules for generating light are integrated in LED luminaires. The LED modules used for this purpose are often constructed in accordance with the desired operating data in such a way that LEDs are interconnected in series in so-called strings and a plurality of such strings are connected in parallel on a module. By way of example, such an LED module can include 40 LEDs, wherein four strings each containing ten LEDs connected in series are connected in parallel.

If an LED luminaire includes a plurality of LED modules, often the LED modules are also connected in parallel and supplied with energy by a common driver. In particular, this is the case for luminaires which, on account of insufficient mechanical protection against electric shock, use only components which satisfy the requirements in respect of SELV insulation according to IEC 60598. Since voltages higher than 60 VDC are not permitted to occur at touchable parts in such luminaires, LED modules specifically for aspects of the disclosure of this type have low operating voltages and, in order to keep the output voltage of the driver below 60 V, are connected to the driver in parallel.

In general, constant-current drivers are used for the operation of such LED modules connected in parallel, said constant-current drivers supplying an approximately constant current independently of the operating voltage of the load. This current corresponds to the sum of the operating currents required by the individual LED modules for their function.

Whereas the earlier the LED modules of an LED luminaire were generally incorporated in a fixed fashion, there is a trend for fitting the LED modules in the LED luminaire in a removable fashion. In the event of the failure of one LED module, it is then easily possible to exchange the defective LED module without the entire LED luminaire having to be removed.

If the LED luminaire is operated with a constant-current driver, problems can occur when an LED module is removed because the output current of the driver is not reduced by the value corresponding to the operating current of the removed LED module. Such a problem also occurs if a user attempts to reduce the luminosity and energy consumption of the luminaire by removing an LED module.

Since the total current supplied by the driver is distributed among a smaller number of remaining LED modules in this case, the latter may be overloaded and thus jeopardize the safety of the luminaire. The overloading can also result in the failure of further LED modules, as a result of which this effect is additionally intensified.

This safety risk exists particularly in the case of luminaires that use LED modules for base lampholder systems. Such lampholder systems enable the operator to exchange or remove LED modules particularly easily without using tools.

Said safety risk can be avoided by using constant-voltage drivers in luminaires. In this case, the driver outputs an approximately constant voltage independently of the current supplied. The current supplied arises as the sum of the operating currents drawn by the LED modules at this voltage. If one of the LED modules connected in parallel is removed, the total current of the driver decreases. On the other hand, the current and the power consumption of the remaining LED modules remain virtually unchanged. What is disadvantageous here is that dimming of the LED modules can only be effected on the module side and special circuitry and control techniques are required for this. Dimming by means of pulse width modulation of the supply voltage is usually undesirable on account of the high light modulation resulting therefrom.

A further possibility is to limit the current flowing through an LED module on the module side. That can be achieved for example by each LED module having integrated current limiting. However, this is associated with the use of circuits having power components, which significantly increases the production costs of an LED module.

BRIEF DESCRIPTION OF THE FIGURES

Further features and implementations of the disclosure will become apparent from the description of exemplary aspects of the disclosure with reference to the accompanying drawings.

DETAILED DESCRIPTION

Figure 1:
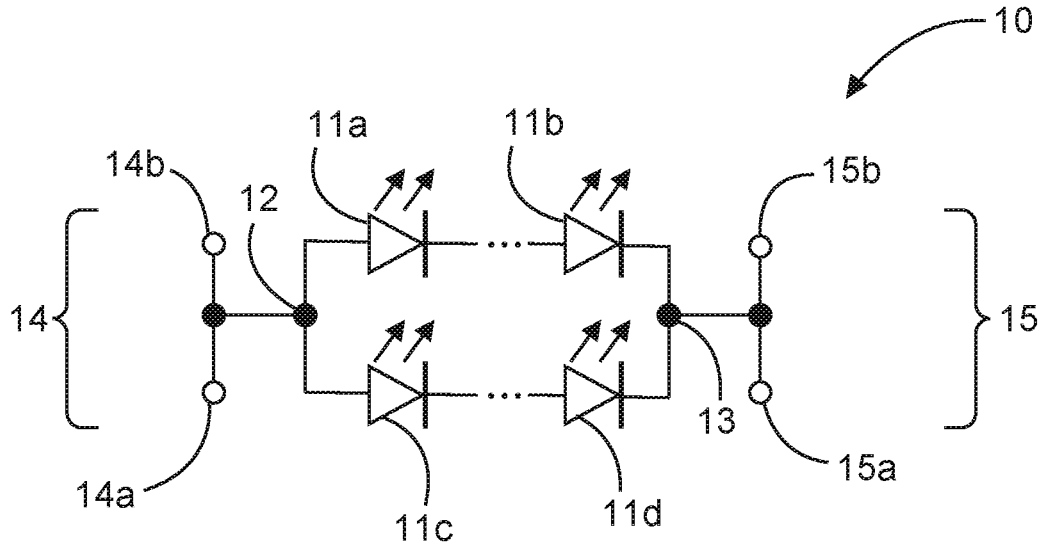
FIG. 1 shows a schematic circuit diagram of an LED module which is suitable for use in the present disclosure.

It is therefore an object of the present disclosure to provide an LED module and respectively a circuit arrangement for an LED luminaire in such a way that in the event of a single LED module or a plurality of LED modules being removed, the LED luminaire is protected against overloading of one or more LED modules remaining in the LED luminaire.

The object is achieved by means of an LED module as claimed in claim 1, a circuit device as claimed in claim 4 and respectively by means of an LED luminaire as claimed in claim 9 or 13. Developments of the disclosure are specified in each of the dependent claims. In this case, each device can also be developed by the features of other devices given below or presented in the dependent claims, or vice versa.

The LED module according to the disclosure includes at least one LED string including one light emitting diode or a plurality of light emitting diodes connected in series with one another, an anode terminal and a cathode terminal. The anode terminal includes a plurality of anode terminal contacts, which are arranged in a manner spatially separated from one another and of which at least two are electrically connected to one another, but not to an anode side of an LED string, and at least one is electrically connected to the anode side of at least one LED string. The cathode terminal includes a plurality of cathode terminal contacts, which are arranged in a manner spatially separated from one another and of which at least two are electrically connected to one another, but not to a cathode side of an LED string and at least one is electrically connected to the cathode side of at least one LED string.

With such an LED module it is possible to construct an LED luminaire in which it can be ensured, for example, that in the event of one LED module being removed from the LED luminaire, no closed electrical circuit remains between the driver and any of the remaining LED modules. As a result, it is possible for example to prevent a situation in which one of the LED modules remaining in the LED luminaire is overloaded and thus the safety of the luminaire is jeopardized or the overloaded LED module itself fails.

In one advantageous development, the LED module includes a plurality of LED strings, each of which includes one light emitting diode or a plurality of light emitting diodes connected in series to one another, wherein each of the LED strings is connected to a common anode terminal contact and/or to a common cathode terminal contact.

As a result, for example, for a predefined operating voltage, the brightness of the LED module can be increased with provision being made of a minimum number of the anode and cathode terminal contacts required for realizing the disclosure.

In one advantageous development, the LED module includes a plurality of LED strings, each of which includes one light emitting diode or a plurality of light emitting diodes connected in series to one another, wherein at least two of the LED strings are connected to mutually different anode terminal contacts and/or to mutually different cathode terminal contacts.

As a result, for example, for a predefined operating voltage, the brightness of the LED module can be increased, and at least two LED strings can be operated separately from one another.

A circuit arrangement according to the disclosure serves for connecting a plurality of LED modules according to the disclosure in parallel. The circuit arrangement includes a positive pole terminal and a negative pole terminal for connecting a driver for supplying the LED modules with electrical energy, a positive pole terminal line for electrically connecting the positive pole terminal to the LED modules, a negative pole terminal line for electrically connecting the negative pole terminal to the LED modules, a plurality of positive pole terminal contacts for electrically connecting the positive pole terminal line to the anode terminal contacts of the LED modules, and a plurality of negative pole terminal contacts for electrically connecting the negative pole terminal line to the cathode terminal contacts of the LED modules, wherein the number and positional relationship of the positive pole terminal contacts and of the negative pole terminal contacts provided for an LED module correspond to the number and positional relationship of the anode terminal contacts and of the cathode terminal contacts of the corresponding LED module, the positive pole terminal contacts are arranged along the positive pole terminal line such that the LED modules corresponding to them are connectable to the positive pole terminal line in a first order as viewed from the positive pole terminal, the negative pole terminal contacts are arranged along the negative pole terminal line such that the LED modules corresponding to them are connectable to the negative pole terminal line in a second order, which is the inverse of the first order, as viewed from the negative pole terminal, the positive pole terminal line is interrupted at least between two positive pole terminal contacts of each LED module, such that it is subdivided into line sections that are not connected to one another, and the negative pole terminal line is interrupted at least between two negative pole terminal contacts of each LED module, such that it is subdivided into line sections that are not connected to one another.

With such a circuit arrangement it is possible to construct an LED luminaire in which it can be ensured, for example, that in the event of one LED module being removed from the LED luminaire, no closed electrical circuit remains between the driver and any of the remaining LED modules. As a result, it is possible for example to prevent a situation in which one of the LED modules remaining in the LED luminaire is overloaded and thus the safety of the luminaire is jeopardized or the overloaded LED module itself fails.

In one advantageous development, the positive pole terminal line is interrupted between those positive pole terminal contacts of each LED module whose corresponding anode terminal contacts on the corresponding LED module are electrically connected to one another, and the negative pole terminal line is interrupted between those negative pole terminal contacts of each LED module whose corresponding cathode terminal contacts on the corresponding LED module are electrically connected to one another.

As a result, for example, the circuit arrangement can be used in combination with arbitrary LED modules having in each case two anode and cathode terminal contacts, respectively, that are electrically connected to one another.

In one advantageous development, the circuit arrangement is configured for connecting in parallel a plurality of LED modules according to the disclosure, wherein each line section of the positive pole terminal line which leads from the positive pole terminal contacts of an LED module in the direction toward the positive pole terminal is electrically connected both to a positive pole terminal contact which corresponds to one of the anode terminal contacts which are electrically connected to one another, but not to an LED string, and to at least one positive pole terminal contact which is electrically connected to an LED string, and/or each line section of the negative pole terminal line which leads from the negative pole terminal contacts of an LED module in the direction toward the negative pole terminal is electrically connected both to a negative pole terminal contact which corresponds to one of the cathode terminal contacts which are electrically connected to one another, but not to an LED string, and to at least one negative pole terminal contact which is electrically connected to an LED string.

As a result, for example, the circuit construction can be used in combination with LED modules according to the disclosure in which the functions of disconnecting and respectively connecting the line sections and supplying current to the LED strings are carried out by way of contact terminals separated from one another.

In one advantageous development, the circuit arrangement furthermore includes a driver, which is electrically connected to the positive pole terminal and the negative pole terminal.

As a result, for example, the LED modules connected to the circuit construction can be supplied with electrical energy in a simple manner.

In one advantageous development, the driver is a constant-current driver.

As a result, for example, particularly simple operation of LED modules connected in parallel can be realized.

An LED luminaire according to the disclosure includes a circuit arrangement according to the disclosure and at least two LED modules.

With such an LED luminaire, it can be ensured, for example, that in the event of one LED module being removed from the LED luminaire, no closed electrical circuit remains between the driver and any of the remaining LED modules. As a result, it is possible for example to prevent a situation in which one of the LED modules remaining in the LED luminaire is overloaded and thus the safety of the luminaire is jeopardized or the overloaded LED module itself fails.

In one advantageous development, the individual LED modules are embodied as LED modules according to the disclosure.

As a result, for example, in the luminaire the circuit construction according to the disclosure can be combined with LED modules according to the disclosure in which the functions of disconnecting and respectively connecting the line sections and supplying current to the LED strings are carried out by way of contact terminals separated from one another.

In one advantageous development, the individual LED modules are inserted into the LED luminaire in a removable fashion.

As a result, for example, particularly simple exchange of the LED modules can be realized.

In one advantageous development, the individual LED modules are fitted such that the anode terminal contacts of each LED module are in contact with the positive pole terminal contacts corresponding to them and the cathode terminal contacts of each LED module are in contact with the negative pole terminal contacts corresponding to them.

As a result, for example, a 1:1 correspondence between the mutually corresponding terminal contacts can be achieved.

A further LED luminaire according to the disclosure includes a driver and at least two LED modules connected in parallel with one another. The LED modules are configured and connected to the driver such that in the event of one LED module being removed from the LED luminaire, no closed electrical circuit remains between the driver and any of the remaining LED modules.

With such an LED luminaire, it is possible for example to prevent a situation in which one of the LED modules remaining in the LED luminaire is overloaded and thus jeopardizes the safety of the luminaire or the overloaded module fails.

As a result, for example, the luminaire can be operated with LED modules according to the disclosure in which the functions of disconnecting and respectively connecting the line sections and supplying current to the LED strings are carried out by way of contact terminals separated from one another.

In one advantageous development, the individual LED modules are inserted into the LED luminaire in a removable fashion.

As a result, for example, particularly simple exchange of the LED modules can be realized.

Embodiments of the present disclosure are described below with reference to the accompanying drawings.

FIG. 1 shows a schematic circuit diagram of an LED module suitable for use in the present disclosure.

The LED module 10 includes a plurality of light emitting diodes 11*a*, 11*b*, 11*c*, 11*d*, which are connected between a common anode terminal node 12 and a common cathode terminal node 13. In the figure, as a non-limiting example, in each case two light emitting diodes are connected in series with one another as a string between the anode terminal node 12 and the cathode terminal node 13, and two strings of light emitting diodes are connected in parallel with one another. However, the number of diodes per string and the number of strings connected in parallel can be chosen as desired.

The LED module 10 furthermore includes an anode terminal 14 for feeding an anode voltage from outside to the LED module, and a cathode terminal 15 for feeding a cathode voltage from outside to the LED module.

The anode terminal 14 includes two anode terminal contacts 14*a*, 14*b*, which are arranged in a manner spatially separated from one another and both of which are electrically connected to one another and to the common anode terminal node 12. Likewise, the cathode terminal 15 includes two cathode terminal contacts 15*a*, 15*b*, which are arranged in a manner spatially separated from one another and both of which are electrically connected to one another and to the common cathode terminal node 13.

Such an LED module can be embodied mechanically for example such that the individual light emitting diodes are arranged on the front side of a substrate and are connected to one another by way of conductor tracks fitted on the substrate. The terminal contacts can be formed by terminal pads, for example, which are arranged on the front or rear side of the substrate and are electrically connected to the light emitting diodes by way of conductor tracks and/or through or side contacts.

Figure 2:
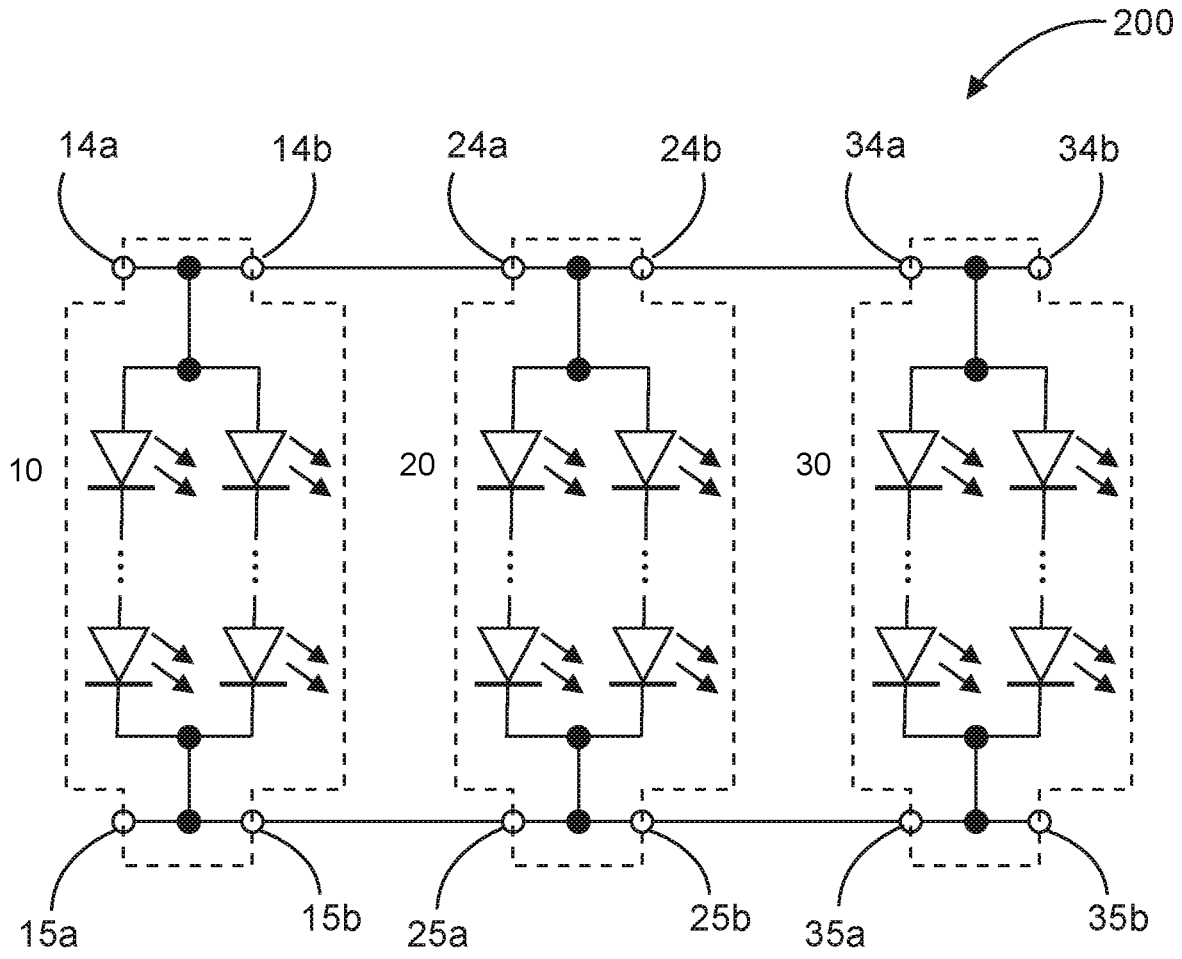
FIG. 2 shows a schematic circuit diagram of a parallel circuit of LED modules with a construction as shown in FIG. 1.

FIG. 2 shows a schematic circuit diagram of a parallel circuit of LED modules.

The figure shows, as a non-limiting example, a parallel circuit 200 of three LED modules 10, 20, 30. In this case, the LED modules 20 and 30 are constructed in the manner as described above for the LED module 10. The parallel circuit is achieved by the anode terminal contacts 14*a*, 14*b*, 24*a*, 24*b*, 34*a*, 34*b* in each case being electrically connected to one another, and by the cathode terminal contacts 15*a*, 15*b*, 25*a*, 25*b*, 35*a*, 35*b* likewise being electrically connected to one another.

Figure 3:
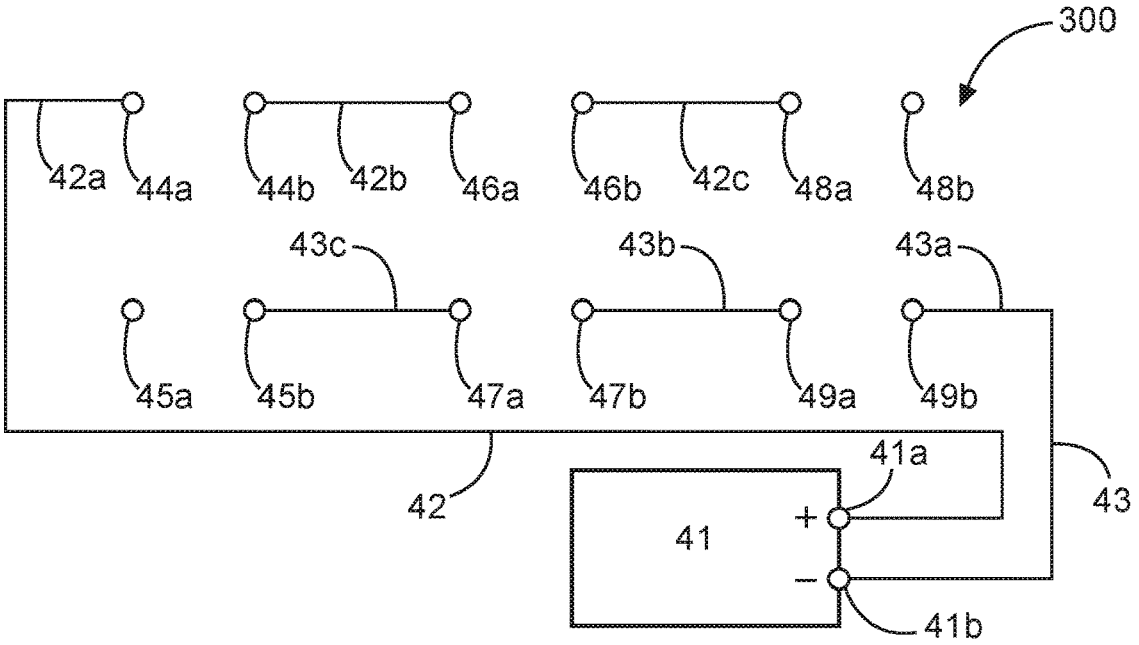
FIG. 3 shows a schematic circuit diagram of a circuit arrangement for operating LED modules in accordance with one aspect of the disclosure of the present disclosure.

FIG. 3 shows a schematic circuit diagram of a circuit arrangement suitable for supplying current to such a parallel circuit of LED modules.

The circuit arrangement 300 includes a positive pole terminal 41*a* and a negative pole terminal 41*b*, to each of which terminals is connected a driver 41 serving for supplying current. The driver 41 is preferably formed as a constant-current driver. A positive pole terminal line 42 and a negative pole terminal line 43 serve in each case for connecting the LED modules 10, 20, 30 to the positive pole terminal 41*a* and the negative pole terminal 41*b*, respectively.

For this purpose, the positive pole terminal line 42 includes a plurality of positive pole terminal contacts 44*a*, 44*b*, 46*a*, 46*b*, 48*a*, 48*b* for connecting the positive pole terminal line 42 to the anode terminal contacts 14*a*, 14*b*, 24*a*, 24*b*, 34*a*, 34*b* of the LED modules 10, 20, 30, and a plurality of negative pole terminal contacts 45*a*, 45*b*, 47*a*, 47*b*, 49*a*, 49*b* for connecting the negative pole terminal line 43 to the cathode terminal contacts 15*a*, 15*b*, 25*a*, 25*b*, 35*a*, 35*b* of the LED modules 10, 20, 30. The number and arrangement of the positive pole terminal contacts 44*a*, 44*b*, 46*a*, 46*b*, 48*a*, 48*b* and of the negative pole terminal contacts 45*a*, 45*b*, 47*a*, 47*b*, 49*a*, 49*b* are chosen such that they correspond to the number and arrangement of the anode terminal contacts 14*a*, 14*b*, 24*a*, 24*b*, 34*a*, 34*b* and of the cathode terminal contacts 15*a*, 15*b*, 25*a*, 25*b*, 35*a*, 35*b* of the LED modules 10, 20, 30, such that when the LED modules 10, 20, 30 are inserted into the circuit arrangement 300, they are electrically connected to the respective positive pole terminal contacts 44*a*, 44*b*, 46*a*, 46*b*, 48*a*, 48*b* and negative pole terminal contacts 45*a*, 45*b*, 47*a*, 47*b*, 49*a*, 49*b*.

The following construction thus arises for the aspect of the disclosure of the LED modules as described above with reference to FIG. 1:

In the positive pole terminal line 42, as viewed from the positive pole terminal 41*a*, the positive pole terminal contacts 44*a* and 44*b* for the LED module 10, the positive pole terminal contacts 46*a* and 46*b* for the LED module 20 and the positive pole terminal contacts 44*a* and 44*b* for the LED module 30 lie one behind another in this order. In this case, the positive pole terminal line 42 is interrupted between the positive pole terminal contacts of the same LED module and is therefore subdivided into a plurality of line sections 42*a*, 42*b*, 42*c*. The line section 42*a* leads from the positive pole terminal 41*a* to the positive pole terminal contact 44*a*. The line section 42*b* leads from the positive pole terminal contact 44*b* to the positive pole terminal contact 46*a*. The line section 42*c* leads from the positive pole terminal contact 46*b* to the positive pole terminal contact 48*a*. The positive pole terminal contact 48*b* remains unconnected.

In the negative pole terminal line 43, as viewed from the negative pole terminal 41*b*, the negative pole terminal contacts 49*b* and 49*a* for the LED module 30, the negative pole terminal contacts 47*b* and 47*a* for the LED module 20 and the negative pole terminal contacts 45*b* and 45*a* for the LED module 10 lie one behind another in this order. In this case, the negative pole terminal line 43 is interrupted between the negative pole terminal contacts of the same LED module and is therefore subdivided into a plurality of line sections 43*a*, 43*b*, 43*c*. The line section 43*a* leads from the negative pole terminal 41*b* to the negative pole terminal contact 49*b*. The line section 43*b* leads from the negative pole terminal contact 49*a* to the negative pole terminal contact 47*b*. The line section 43*c* leads from the negative pole terminal contact 47*a* to the negative pole terminal contact 45*b*. The negative pole terminal contact 45*a* remains unconnected.

The positive pole terminal line 42 and the negative pole terminal line 43 and also the corresponding line sections 42*a*, 42*b*, 42*c*, 43*a*, 43*b*, 43*c* can be formed mechanically for example as wires within an LED luminaire. The positive pole terminal contacts 44*a*, 44*b*, 46*a*, 46*b*, 48*a*, 48*b* and the negative pole terminal contacts 45*a*, 45*b*, 47*a*, 47*b*, 49*a*, 49*b* can be formed by terminal connections, for example.

Figure 4:
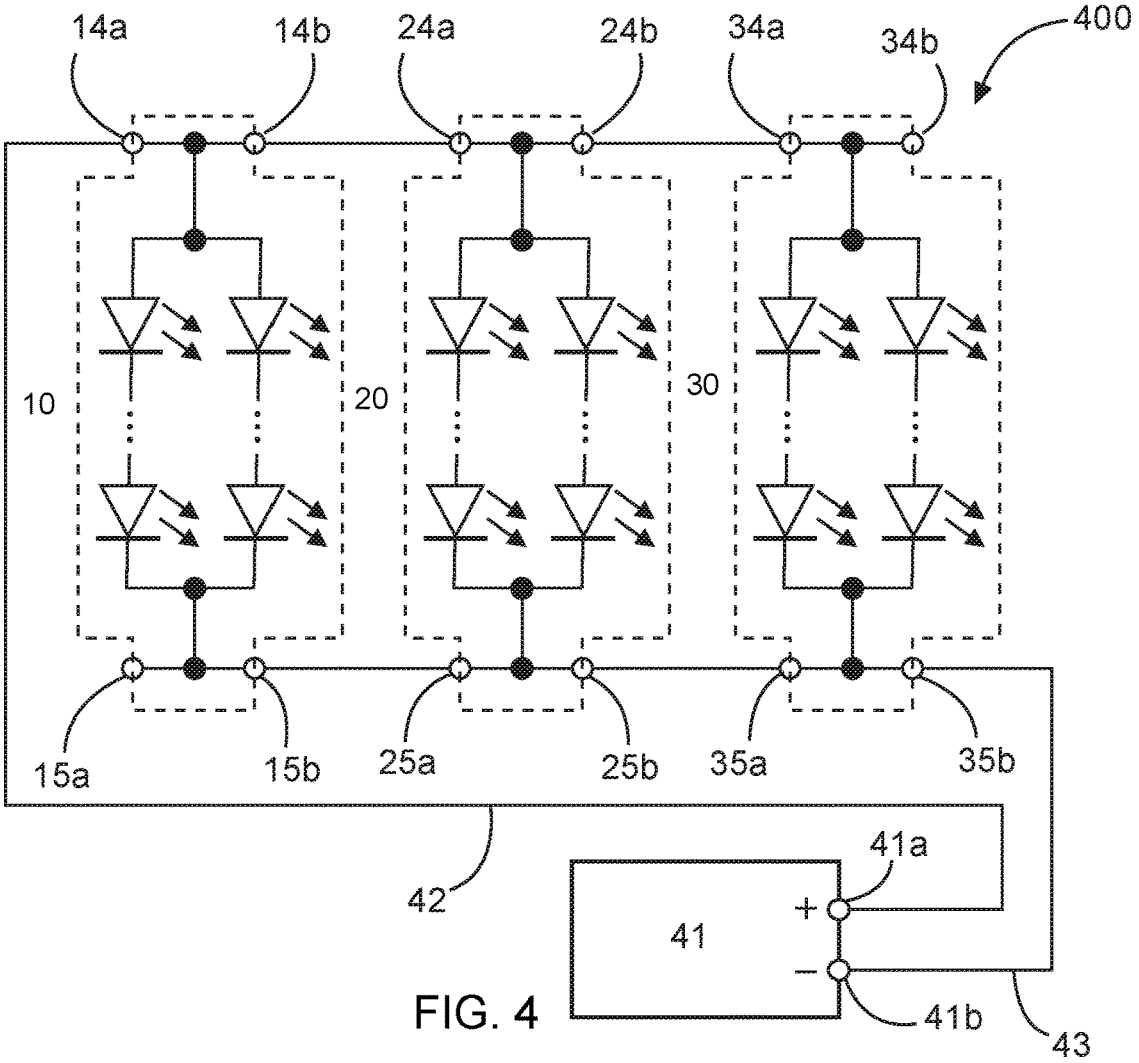
FIG. 4 shows a schematic circuit diagram of an LED luminaire in accordance with one aspect of the disclosure of the present disclosure.

FIG. 4 shows a schematic circuit diagram of an LED luminaire in accordance with one aspect of the disclosure of the present disclosure.

The LED luminaire 400 includes the circuit arrangement 300 and the LED modules 10, 20, 30 inserted therein. The LED modules 10, 20, 30 are inserted into the LED luminaire in a removable fashion. Removable means that they can be removed from the luminaire in a simple manner and without a special tool. In this case, removal can be effected just manually or using a simple and generally available tool such as screwdriver, for example.

In the case of the LED module 10, the anode terminal contact 14*a* contacts the positive pole terminal contact 44*a*, the anode terminal contact 14*b* contacts the positive pole terminal contact 44*b*, the cathode terminal contact 15*a* contacts the negative pole terminal contact 45*a* and the cathode terminal contact 15*a* contacts the negative pole terminal contact 45*a*. The LED modules 20 and 30 are connected in a corresponding manner.

By means of the electrical connections between the respective anode terminal contacts 14*a*-14*b*, 24*a*-24*b*, 34*a*-34*b* provided in the LED modules 10, 20, 30, the line sections 42*a*, 42*b*, 42*c* of the positive pole terminal line 42 are electrically connected to one another, such that all the anode terminal contacts 14*a*, 14*b*, 24*a*, 24*b*, 34*a*, 34*b* are electrically connected to the positive pole terminal 41*a*.

Likewise, the line sections 43*a*, 43*b*, 43*c* of the negative pole terminal line 43 are electrically connected to one another by means of the electrical connections between the respective cathode terminal contacts 15*a*-15*b*, 25*a*-25*b*, 35*a*-35*b* provided in the LED modules 10, 20, 30, such that all the cathode terminal contacts 15*a*, 15*b*, 25*a*, 25*b*, 35*a*, 35*b* are electrically connected to the negative pole terminal 41*b*.

The LED modules 10, 20, 30 in the LED luminaire 400 are thus connected in parallel with one another during normal operation.

If one of the LED modules 10, 20, 30 is removed from the LED luminaire 400, the positive pole terminal line 42 and the negative pole terminal line 43 are interrupted at this location. In the case of the circuit arrangement described above, what is achieved as a result is that the LED modules connected to the positive pole terminal line 42 behind the removed LED module (to the right of the removed LED module in FIG. 4) are no longer connected to the positive pole terminal 41*a*, and that the LED modules connected to the negative pole terminal line 42 behind the removed LED module (to the left of the removed LED module in FIG. 4) are no longer connected to the negative pole terminal 41*b*.

By way of example, in the event of the LED module 10 being removed, the LED modules 20 and 30 are no longer connected to the positive pole terminal 41*a*. In the event of the LED module 20 being removed, the LED module 10 is no longer connected to the negative pole terminal 41*b*, and the LED module 30 is no longer connected to the positive pole terminal 41*a*. In the event of the LED module 30 being removed, the LED modules 10 and 20 are no longer connected to the negative pole terminal 41*b*.

Thus there is no longer any LED module that is connected both to the positive pole terminal 41*a* and to the negative pole terminal 41*b*. Consequently, there is also no longer any closed electrical circuit leading from the positive pole terminal 41*a* to the negative pole terminal 41*b* via an LED module. Therefore, none of the LED modules remaining in the LED luminaire 400 can be overloaded and thus jeopardize the safety of the luminaire or ultimately fail itself.

In accordance with the aspects of the disclosure described above, LED modules having double terminals per pole (anode/cathode) are used. Furthermore, the current-carrying lines of the circuit arrangement are interrupted between the respective two terminals for the LED modules. A continuous conductive connection is established only as a result of the LED modules being inserted. Furthermore, the anode and cathode of the individual LED modules are connected to the driver in an inverted order.

As result, it is possible to preclude an adverse effect on safety in the event of an LED module being removed from the LED luminaire, without the LED modules having to have individual current monitoring and/or limiting. In this case, it is unimportant which or how many LED modules are removed from a luminaire since the electrical circuit including the driver is already interrupted anyway upon an arbitrary LED module being removed.

According to the present disclosure, an operational state of a parallel circuit of LED modules in an LED luminaire is achieved only when all LED modules provided have been inserted into the LED luminaire. If just a single LED module is missing, there is no closed electrical circuit between the driver and any of the remaining LED modules. This effect can however also be achieved in a different way than by means of the specific circuit construction, as described above.

Figure 5:
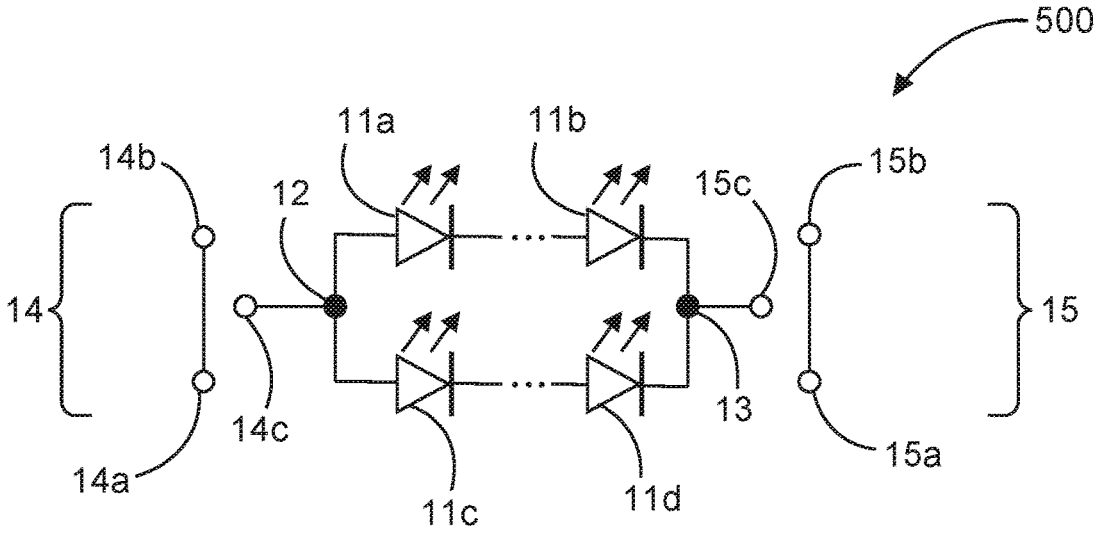
FIG. 5 shows a schematic circuit diagram of an LED module in accordance with one aspect of the disclosure of the present disclosure.

In this regard, LED modules can also be embodied specifically for the present disclosure. By way of example, the functions of electrically connecting two terminal contacts and feeding current to the LED strings can be realized separately from one another. One example of such an LED module is illustrated in FIG. 5. In this case, the constituent parts corresponding to those of the LED module illustrated in FIG. 1 are identified by the same reference signs and will not be described again.

The LED module 500 illustrated in FIG. 5 has, like the LED module 10 illustrated in FIG. 1, two anode terminal contacts 14*a*, 14*b* electrically connected to one another and two cathode terminal contacts 15*a*, 15*b* electrically connected to one another. However, they are not connected to the common anode terminal node 12 and the common cathode terminal node 13, respectively.

Instead, an additionally provided anode terminal contact 14*c* is electrically connected to the anode terminal node 12, and an additionally provided cathode terminal contact 15*c* is electrically connected to the cathode terminal node 13. The additional anode terminal contact 14*c* and the additional cathode terminal contact 15*c* are however not connected to the other anode terminal contacts 14*a*, 14*b* and the other cathode terminal contacts 15*a*, 15*b*, respectively.

Figure 6:
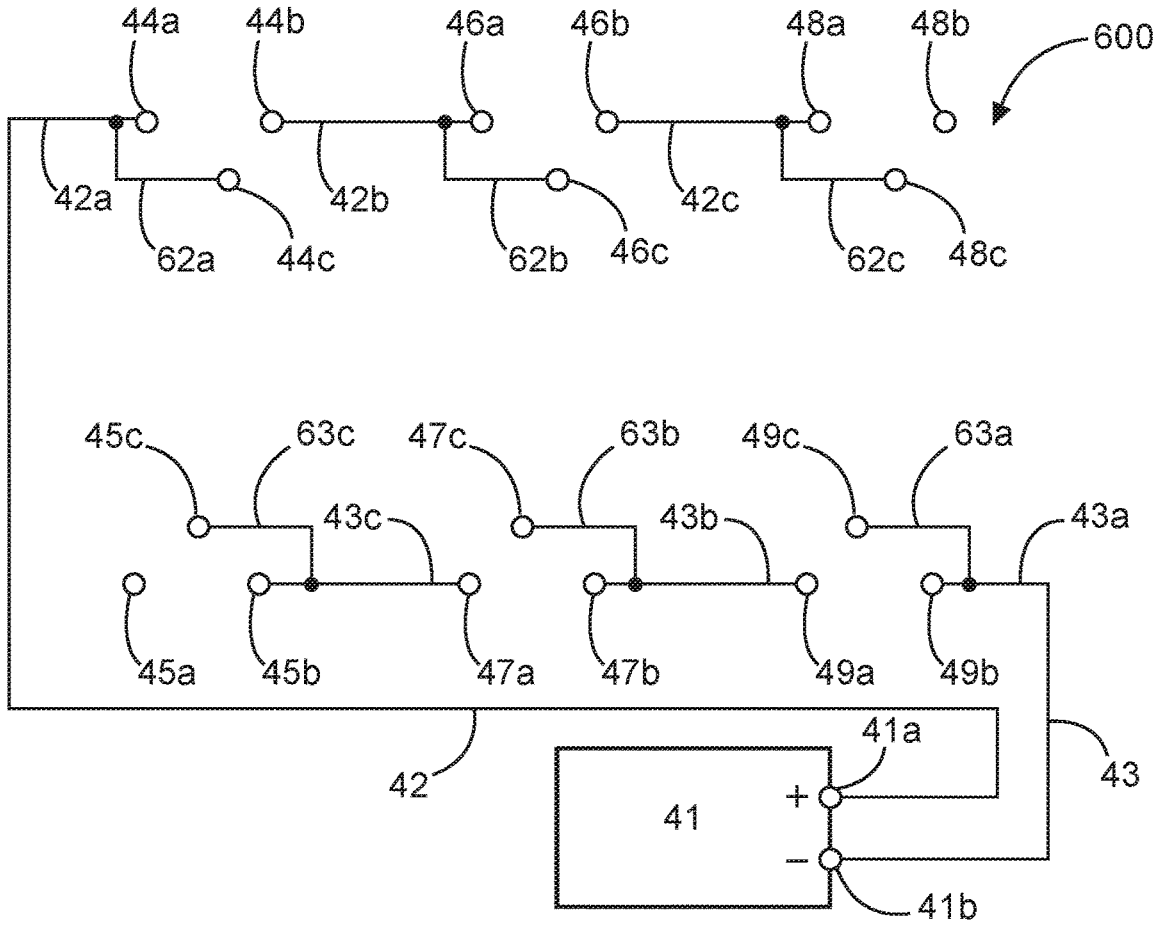
FIG. 6 shows a schematic circuit diagram of a modified circuit arrangement in accordance with one aspect of the disclosure of the present disclosure for operating LED modules shown in FIG. 5.

FIG. 6 shows a schematic circuit diagram of a modified circuit arrangement suitable for supplying current to a parallel circuit of LED modules 500. Here, too, the constituent parts corresponding to those of the circuit arrangement illustrated in FIG. 3 are identified by the same reference signs and will not be described again.

The circuit arrangement 600 shown in FIG. 6 includes additional positive pole terminal contacts 44*c*, 46*c*, 48*c* and negative pole terminal contacts 45*c*, 47*c*, 49*c*, which are provided for connecting the positive pole terminal line 42 and the negative pole terminal line 43, respectively, to the additional anode terminal contact 14*c* and the additional cathode terminal contact 15*c*, respectively, of the LED modules 500 to be connected. Said additional positive pole terminal contacts 44*c*, 46*c*, 48*c* and negative pole terminal contacts 45*c*, 47*c*, 49*c* are in each case electrically connected to the positive pole terminal line 42 and the negative pole terminal line 43, respectively, via line sections 62*a*, 62*b*, 62*c*, 63*a*, 63*b*, 63*c*. In this case, each of the additional positive pole terminal contacts 44*c*, 46*c*, 48*c* and negative pole terminal contacts 49*c*, 47*c*, 45*c* is electrically connected to that line section 42*a*, 42*b*, 42*c*, 43*a*, 43*b*, 43*c* of the positive pole terminal line 42 and of the negative pole terminal line 43, respectively, which leads from the terminal contacts of an LED module to the positive and negative poles 41*a*, 41*b*, respectively.

As an alternative to the aspect of the disclosure shown in FIG. 6, each of the additional positive pole terminal contacts and negative pole terminal contacts can also be electrically connected to that line section of the positive pole terminal line and of the negative pole terminal line, respectively, which leads from the terminal contacts of an LED module away from the positive and negative poles, respectively. After insertion of the module, via the electrical connection between the anode terminal contacts 14*a*, 14*b* and the cathode terminal contacts 15*a*, 15*b*, respectively, said line sections are likewise connected to the lines leading to the positive and negative poles, respectively, and can therefore likewise carry out the supply of current to the LED diodes.

In this aspect of the disclosure, therefore, the anode terminal contacts 14*a*, 14*b* and the cathode terminal contacts 15*a*, 15*b* perform the function of bridging the line interruption of the positive pole terminal line 42 and of the negative pole terminal line 43, respectively. Separately therefrom, the anode terminal contact 14*c* and the cathode terminal contact 15*c* carry out the feeding of current to the light emitting diodes 11*a*, 11*b*, 11*c*, 11*d*.

Figure 7:
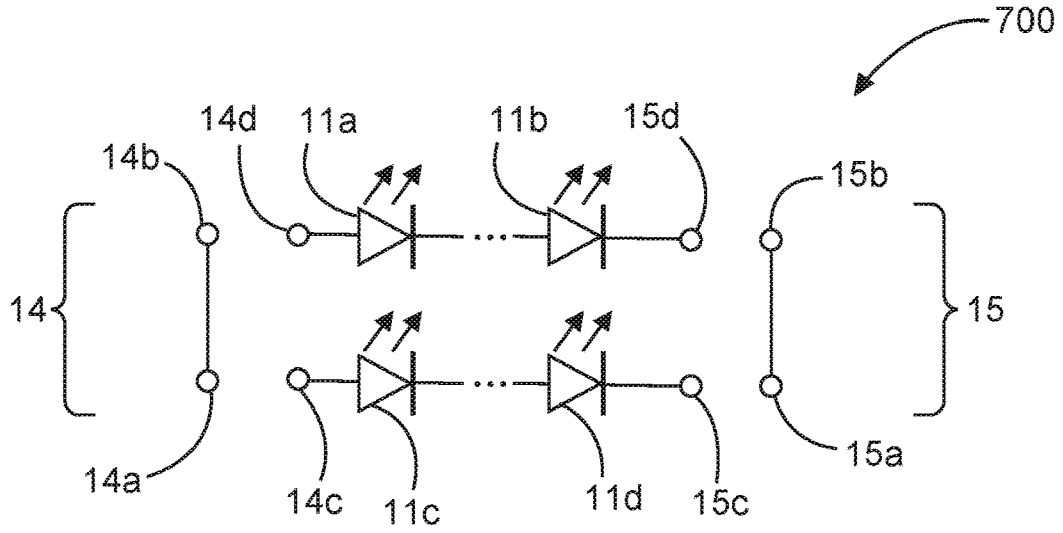
FIG. 7 shows a schematic circuit diagram of a further LED module in accordance with one aspect of the disclosure of the present disclosure.

As a further alternative, for example, each LED string can include a dedicated anode terminal node and/or a dedicated cathode terminal node, and a dedicated anode and/or cathode terminal contact can be provided for each of said anode and/or cathode terminal nodes. One example of such an LED module is illustrated in FIG. 7. In this case, the constituent parts corresponding to those of the LED module illustrated in FIG. 1 are identified by the same reference signs and will not be described again.

The LED module 700 illustrated in FIG. 7 has, like the LED module 10 illustrated in FIG. 1, two anode terminal contacts 14*a*, 14*b* electrically connected to one another and two cathode terminal contacts 15*a*, 15*b* electrically connected to one another. However, they are not connected to the light emitting diodes 11*a*, 11*b*, 11*c*, 11*d*.

In this aspect of the disclosure, the light emitting diodes form two strings 11*a*, 11*b*, and 11*c*, 11*d*, which however are not electrically connected to one another. Instead, the anode side of each string is connected to a dedicated anode terminal contact 14*c*, 14*d*, and the cathode side of each string is connected to a dedicated cathode terminal contact 15*c*, 15*d*.

Figure 8:
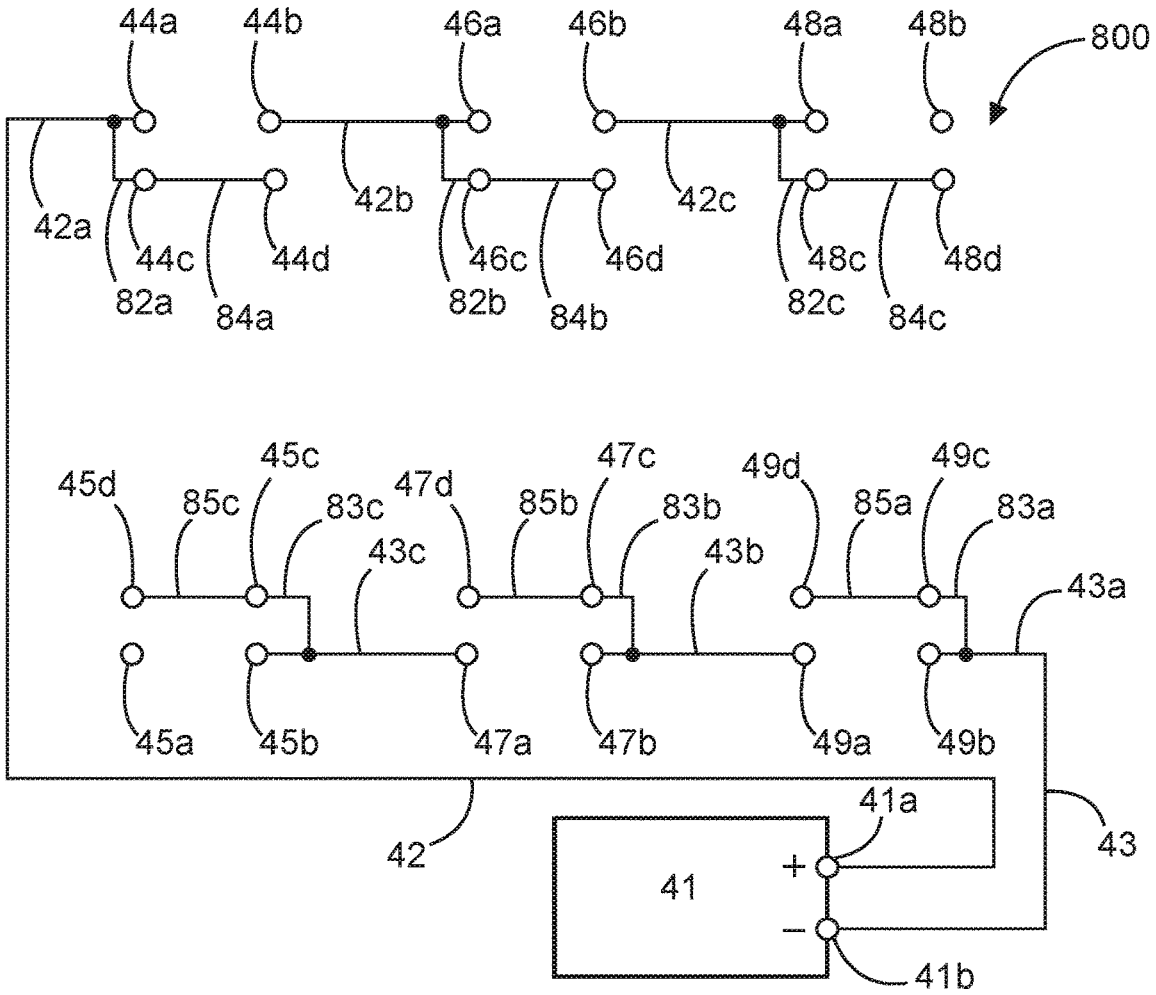
FIG. 8 shows a schematic circuit diagram of a further modified circuit arrangement in accordance with one aspect of the disclosure of the present disclosure for operating LED modules shown in FIG. 7.

FIG. 8 shows a schematic circuit diagram of a further modified circuit arrangement suitable for supplying current to a parallel circuit of LED modules 700. Here, too, the constituent parts corresponding to those of the circuit arrangement illustrated in FIG. 6 are identified by the same reference signs and will not be described again.

The circuit arrangement 800 shown in FIG. 8 includes further positive pole terminal contacts 44*d*, 46*d*, 48*d* and negative pole terminal contacts 49*d*, 47*d*, 45*d*, which are provided for connecting the positive pole terminal line 42 and the negative pole terminal line 43, respectively, to the additional anode terminal contact 14*d* and the additional cathode terminal contact 15*d*, respectively, of the LED modules 700 to be connected. The positive pole terminal contacts and respectively the negative pole terminal contacts of a module are electrically connected to one another via additional line sections 82*a*, 82*b*, 82*c*, 83*a*, 83*b*, 83*c*.

As described as an alternative to the circuit arrangement 600, each of the positive and respectively negative pole terminal contacts which corresponds to one of the anode and respectively cathode terminal contacts of an LED module which are connected to an LED string can also be connected to any of the two line sections of the positive and respectively negative pole terminal lines that lead to said LED module. In this case, all of these positive and respectively negative pole terminal contacts can be connected to the same line section. Alternatively, one portion of these positive and respectively negative pole terminal contacts can be connected to one of said line sections, and another portion to the other line section.

The aspects of the disclosure can also be combined with one another. In this regard, for example, in a manner similar to that shown in FIG. 7, a plurality of additional anode and respectively cathode terminal contacts can be provided, each of which is connected at least to one LED string. However, one or more of the additional anode and respectively cathode terminal contacts can also be connected to two or more LED strings connected in parallel.

Further modifications of the aspects of the disclosure specifically described are possible as long as it is ensured that in the event of one LED module being removed from the LED luminaire, no closed electrical circuit remains between the driver and any of the remaining LED modules.

LIST OF REFERENCE SIGNS

LED module 10, 20, 30, 500, 700
Light emitting diode, LED 11*a-d*
Anode terminal 14
Anode terminal contact 14*a-b*, 24*a-b*, 34*a-b*
Anode terminal node 12
Cathode terminal 15
Cathode terminal contact 15*a-b*, 24*a-b*, 34*a-b*
Cathode terminal node 13
Driver 41
Positive pole terminal 41*a*
Negative pole terminal 41*b*
Positive pole terminal line 42
Line section 42*a-c*, 62*a-c*, 82*a-c*, 84*a-c*
Negative pole terminal line 43
Line section 43*a-c*, 63*a-c*, 83*a-c*, 85*a-c*
Positive pole terminal contact 44*a-b*, 46*a-b*, 48*a-b*,
Negative pole terminal contact 45*a-b*, 47*a-b*, 49*a-b*
Parallel circuit 200
Circuit arrangement 300, 600, 800
LED luminaire 400

The invention claimed is:

1. An LED module, comprising at least one LED string comprising one light emitting diode or a plurality of light emitting diodes connected in series with one another, an anode terminal and a cathode terminal, wherein the anode terminal comprises a plurality of anode terminal contacts, which are arranged in a manner spatially separated from one another and of which at least two are electrically connected to one another, but not to an anode side of an LED string, and at least one is electrically connected to the anode side of at least one LED string, and the cathode terminal comprises a plurality of cathode terminal contacts, which are arranged in a manner spatially separated from one another and of which at least two are electrically connected to one another, but not to a cathode side of an LED string and at least one is electrically connected to the cathode side of at least one LED string.

2. The LED module as claimed in claim 1, comprising a plurality of LED strings, each of which comprises one light emitting diode or a plurality of light emitting diodes connected in series to one another, wherein each of the plurality of LED strings is connected to a common anode terminal contact and/or to a common cathode terminal contact.

3. The LED module as claimed in claim 1, comprising a plurality of LED strings, each of which comprises one light emitting diode or a plurality of light emitting diodes connected in series to one another, wherein at least two of the LED strings are connected to mutually different anode terminal contacts and/or to mutually different cathode terminal contacts.

4. A circuit arrangement for connecting a plurality of LED modules in parallel, comprising a positive pole terminal and a negative pole terminal for connecting a driver for supplying the plurality of LED modules with electrical energy, a positive pole terminal line for electrically connecting the positive pole terminal to the plurality of LED modules, a negative pole terminal line for electrically connecting the negative pole terminal to the LED modules, a plurality of positive pole terminal contacts for electrically connecting a positive pole terminal line to anode terminal contacts of the LED modules, and a plurality of negative pole terminal contacts for electrically connecting a negative pole terminal line to cathode terminal contacts of the LED modules, wherein a number and a positional relationship of positive pole terminal contacts provided for an LED module and of negative pole terminal contacts correspond to a number and a positional relationship of the anode terminal contacts and of the cathode terminal contacts of a corresponding LED module, the plurality of positive pole terminal contacts are arranged along the positive pole terminal line such that LED modules corresponding to them are connectable to the positive pole terminal line in a first order as viewed from the positive pole terminal, the plurality of negative pole terminal contacts are arranged along the negative pole terminal line such that the LED modules corresponding to them are connectable to the negative pole terminal line in a second order, which is an inverse of the first order, as viewed from the negative pole terminal, the positive pole terminal line is interrupted at least between two positive pole terminal contacts of each LED module, such that it is subdivided into line sections that are not connected to one another, and the negative pole terminal line is interrupted at least between two negative pole terminal contacts of each LED module, such that it is subdivided into line sections that are not connected to one another.

5. The circuit arrangement as claimed in claim 4, wherein the positive pole terminal line is interrupted between those positive pole terminal contacts of each LED module whose corresponding anode terminal contacts on the corresponding LED module are electrically connected to one another, and the negative pole terminal line is interrupted between those negative pole terminal contacts of each LED module whose corresponding cathode terminal contacts on the corresponding LED module are electrically connected to one another.

6. The circuit arrangement as claimed in claim 4, which is configured for connecting in parallel a plurality of LED modules comprising:

at least one LED string comprising one light emitting diode or a plurality of light emitting diodes connected in series with one another, an anode terminal and a cathode terminal, wherein the anode terminal comprises a plurality of anode terminal contacts, which are arranged in a manner spatially separated from one another and of which at least two are electrically connected to one another, but not to an anode side of an LED string, and at least one is electrically connected to the anode side of at least one LED string, and the cathode terminal comprises a plurality of cathode terminal contacts, which are arranged in a manner spatially separated from one another and of which at least two are electrically connected to one another, but not to a cathode side of an LED string and at least one is electrically connected to the cathode side of at least one LED string;

wherein each of the positive pole terminal contacts which corresponds to one of the plurality of anode terminal contacts of an LED module which are electrically connected to at least one LED string is electrically connected to one of the line sections of the positive pole terminal line which is connected to one of the positive pole terminal contacts which corresponds to one of the plurality of the anode terminal contacts of the corresponding LED module which are electrically connected to one another, but not to an LED string, and/or each of the negative pole terminal contacts which corresponds to one of the cathode terminal contacts of an LED module which are electrically connected to at least one LED string is electrically connected to one of the line sections of the negative pole terminal line which is connected to one of the negative pole terminal contacts which corresponds to one of the cathode terminal contacts which are electrically connected to one another, but not to an LED string.

7. The circuit arrangement as claimed in claim 4, furthermore comprising a driver, which is electrically connected to the positive pole terminal and the negative pole terminal.

8. The circuit arrangement as claimed in claim 7, wherein the driver is a constant-current driver.

9. An LED luminaire comprising a circuit arrangement as claimed in claim 4 and at least two LED modules.

10. The LED luminaire as claimed in claim 9, wherein the LED modules are formed as LED modules comprising:

at least one LED string comprising one light emitting diode or a plurality of light emitting diodes connected in series with one another, an anode terminal and a cathode terminal, wherein the anode terminal comprises a plurality of anode terminal contacts, which are arranged in a manner spatially separated from one another and of which at least two are electrically connected to one another, but not to an anode side of an LED string, and at least one is electrically connected to the anode side of at least one LED string, and the cathode terminal comprises a plurality of cathode terminal contacts, which are arranged in a manner spatially separated from one another and of which at least two are electrically connected to one another, but not to a cathode side of an LED string and at least one is electrically connected to the cathode side of at least one LED string.

11. The LED luminaire as claimed in claim 9, wherein the LED modules are inserted into the LED luminaire in a removable fashion.

12. The LED luminaire as claimed in claim 9, wherein the individual LED modules are fitted such that the anode terminal contacts of each LED module are in contact with the positive pole terminal contacts corresponding to them and the cathode terminal contacts of each LED module are in contact with the negative pole terminal contacts corresponding to them.

13. An LED luminaire, comprising a driver and a plurality of LED modules connected in parallel with one another, wherein the plurality of LED modules are configured and connected to the driver such that if one LED module is removed from the LED luminaire, no closed electrical circuit remains between the driver and any of the remaining LED modules;

wherein the LED modules are formed as LED modules comprising:

at least one LED string comprising one light emitting diode or a plurality of light emitting diodes connected in series with one another, an anode terminal and a cathode terminal, wherein the anode terminal comprises a plurality of anode terminal contacts, which are arranged in a manner spatially separated from one another and of which at least two are electrically connected to one another, but not to an anode side of an LED string, and at least one is electrically connected to the anode side of at least one LED string, and the cathode terminal comprises a plurality of cathode terminal contacts, which are arranged in a manner spatially separated from one another and of which at least two are electrically connected to one another, but not to a cathode side of an LED string and at least one is electrically connected to the cathode side of at least one LED string.

14. The LED luminaire as claimed in claim 13, wherein the LED modules are inserted into the LED luminaire in a removable fashion.

* * * * *